US007562498B2

(12) United States Patent
Galeazzo et al.

(10) Patent No.: US 7,562,498 B2
(45) Date of Patent: Jul. 21, 2009

(54) ROOF VENTS

(76) Inventors: John P. Galeazzo, P.O. Box 120, Painesville, OH (US) 44077; Stephen J. Galeazzo, P.O. Box 703, Painesville, OH (US) 44077

( * ) Notice: Subject to any disclaimer, the term of this patent is extended or adjusted under 35 U.S.C. 154(b) by 404 days.

(21) Appl. No.: 11/239,857

(22) Filed: Sep. 30, 2005

(65) Prior Publication Data

US 2007/0094953 A1 May 3, 2007

(51) Int. Cl.
*E04B 7/00* (2006.01)
*E04B 1/70* (2006.01)
*E04H 12/28* (2006.01)
*F24F 7/02* (2006.01)

(52) U.S. Cl. ..... 52/198; 52/95; 52/199; 52/302.1; 454/365

(58) Field of Classification Search ..... 52/95, 52/198, 199, 302.1, 12; 454/365
See application file for complete search history.

(56) References Cited

U.S. PATENT DOCUMENTS 2,868,104 A * 1/1959 Honholt et al. ..... 454/365
3,036,508 A * 5/1962 Halvorson ..... 454/250
3,185,070 A * 5/1965 Smith ..... 454/365
4,252,590 A 2/1981 Rasen et al.
4,325,290 A * 4/1982 Wolfert ..... 454/365
4,342,807 A 8/1982 Rasen et al.
4,676,147 A 6/1987 Mankowski
4,762,053 A * 8/1988 Wolfert ..... 454/260
4,776,262 A * 10/1988 Curran ..... 454/260
4,817,506 A 4/1989 Cashman
4,876,950 A * 10/1989 Rudeen ..... 454/365
4,924,761 A 5/1990 MacLeod et al.
4,942,699 A * 7/1990 Spinelli ..... 52/57
4,949,514 A * 8/1990 Weller ..... 52/12
5,009,149 A * 4/1991 MacLeod et al. ..... 454/365
5,054,254 A 10/1991 Sells
5,060,431 A 10/1991 MacLeod et al.
5,094,041 A * 3/1992 Kasner et al. ..... 52/57
5,122,095 A * 6/1992 Wolfert ..... 454/365
5,149,301 A * 9/1992 Gates ..... 454/365
5,174,076 A * 12/1992 Schiedegger et al. ..... 52/199
5,439,417 A 8/1995 Sells
5,458,538 A * 10/1995 MacLeod et al. ..... 454/365
5,542,882 A 8/1996 Sells
5,797,222 A * 8/1998 Martin ..... 52/198
5,803,805 A * 9/1998 Sells ..... 454/364
5,902,432 A * 5/1999 Coulton et al. ..... 156/199
6,149,517 A * 11/2000 Hansen ..... 454/365
6,212,833 B1 * 4/2001 Henderson ..... 52/198
6,447,392 B1 9/2002 Henderson (Continued)

OTHER PUBLICATIONS

"Installation Instructions for Roof Over Ridge Vent", Published Mar. 1995, 5 pages.

(Continued)

*Primary Examiner*—Richard E Chilcot, Jr.
*Assistant Examiner*—Ryan D Kwiecinski
(74) *Attorney, Agent, or Firm*—Pearne & Gordon LLP

(57) ABSTRACT

Roof vents are configured to cover a ventilation opening formed in a roof deck. Roof vents can permit venting of an area underlying the roof deck while shielding the ventilation opening from condensation such as rain. Roof vents can also include a guard for shielding a ventilation area from outside debris.

10 Claims, 3 Drawing Sheets

U.S. PATENT DOCUMENTS

| | | | | |
|---|---|---|---|---|
| 6,537,147 | B2 * | 3/2003 | Smith | 454/365 |
| 6,647,675 | B1 * | 11/2003 | Castellanos | 52/198 |
| 7,044,852 | B2 * | 5/2006 | Horton | 454/365 |
| 2001/0019941 | A1 | 9/2001 | Headrick | |
| 2002/0028652 | A1 | 3/2002 | Henderson | |
| 2004/0088932 | A1 | 5/2004 | Headrick | |
| 2004/0187394 | A1 * | 9/2004 | Brochu | 52/12 |
| 2004/0198216 | A1 | 10/2004 | Morris et al. | |
| 2004/0244303 | A1 * | 12/2004 | Seise, Jr. | 52/12 |
| 2005/0090197 | A1 | 4/2005 | Coulton | |
| 2005/0136831 | A1 * | 6/2005 | Coulton | 454/365 |
| 2008/0289263 | A1 * | 11/2008 | Brochu | 52/12 |

OTHER PUBLICATIONS

Blocksom & Co. Natural Fiber Products, "About Us", Sep. 27, 2005, 1 page.
Blocksom & Co. Natural Fiber Products, "Roof Saver" Sep. 27, 2005, 1 page.
Blocksom & Co. Natural Fiber Products, "Air Filters" Sep. 27, 2005, 1 page.
Blocksom & Co. Natural Fiber Products, "Air Filters" Sep. 27, 2005, 2 pages.
Blocksom & Co. Natural Fiber Products, "Air Filters" Sep. 27, 2005, 2 pages.
DCI Products, Inc., "Flo-Free Leaf Guards", Sep. 27, 2005, 2 pages.
DCI Products, Inc., "Smart Ridge", Sep. 27, 2005, 2 pages.
DCI Products, Inc., "Smart Vent", Sep. 27, 2005, 3 pages.
DCI Products, Inc. "FaciaVent", Sep. 27, 2005, 1 page.
DCI Products, Inc., "Cedar Vent", Sep. 27, 2005, 2 pages.
DCI Products, Inc., "Rafter Vent", Sep. 27, 2005, 1 page.
DCI Products, Inc., "Shed Roof", Sep. 27, 2005, 1 page.
DCI Products, Inc., "Shed Roof", Sep. 27, 2005, 1 page.
DCI Products, Inc., "Shed Roof", Sep. 27, 2005, 1 page.
DCI Products, Inc., "Shed Roof", Sep. 27, 2005, 1 page.
Smart Vent Detailed Instructions, "Smart Vent 6 Step Installation Guide By DCI", Sep. 27, 2005, 3 pages.
"Roof Saver Rolled Ridge Vent", Sep. 27, 2005, 1 page.
"Roof Saver Rolled Ridge Vent, About Us", Sep. 27, 2005, 1 page.
"Roof Saver Rolled Ridge Vent, How It Works", Sep. 27, 2005, 1 page.
"Roof Saver Rolled Ridge Vent, Installation Instructions", Sep. 27, 2005, 2 pages.
Roof Saver, "How Important is the Air We Breathe?", Sep. 27, 2005, 1page.
Roof Saver, "Ventilation: How Does It Work?", Sep. 27, 2005, 1 page.
Deanna Fryer, "From the Earth", Roof Ridge Vent Utilizes Natural Materials, Apr. 2004 issue of Environmental Design & Construction, 2 pages.
Breanna Wurtz, HJE Marketing, "Effective Attic Ventilation: Just What the Doctor Ordered" Sep. 2002, Business News Publishing Co., 2 pages.
Andy Swan, Blocksom & Co., "Now You See It, Now You Don't", Florida Forum, Jul. 2002, 2 pages.

* cited by examiner

ROOF VENTS

FIELD OF THE INVENTION

The present invention relates to venting devices, and more particularly, to roof vents.

BACKGROUND OF THE INVENTION

Building structures can be damaged by moisture trapped within areas of the building. For example, trapped condensation may encourage mold formation and/or promote rotting, rusting, buckling, paint peeling or other deterioration of building frame components. It is known to provide roof vents to help vent moisture that might otherwise damage building structures. Known roof vents are positioned over ventilation openings in a roof deck to permit venting of an area underlying the roof deck while shielding the ventilation opening from condensation such as rain.

Current roof vent designs, however, may trap outside debris and/or permit passage of debris to areas underlying the roof deck. Trapped debris may interfere with roof vent performance and/or may be difficult to remove from the roof vent. Moreover, debris passing through the roof vent can contaminate areas underlying the roof deck. There is a need for roof vents that are effective to vent an area underlying a roof deck, shield the underlying area from condensation, and shield areas of the roof vent from outside debris.

SUMMARY OF THE INVENTION

Accordingly, it is an aspect of the present invention to obviate problems and shortcomings of conventional roof vents.

In accordance with one aspect, a roof comprises a roof deck with a ventilation opening and a weather resistant material. The roof further includes a roof vent attached to the roof deck and extending over the ventilation opening. Still further, the roof includes a removable guard configured to be selectively removed from the roof vent while the roof vent remains attached to the roof deck.

In accordance with another aspect, a roof vent comprises a body including a first wall and a second wall attached to the first wall. The roof vent further includes a first baffle spaced from the first wall and a first removable guard configured to be positioned between a portion of the first baffle and a portion of the first wall.

In accordance with still another aspect, a roof vent comprises a body with a first wall and a second wall attached to the first wall. The roof vent further includes a first baffle spaced from the first wall and a first guard including a portion substantially extending in a direction from the first wall towards the first baffle.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
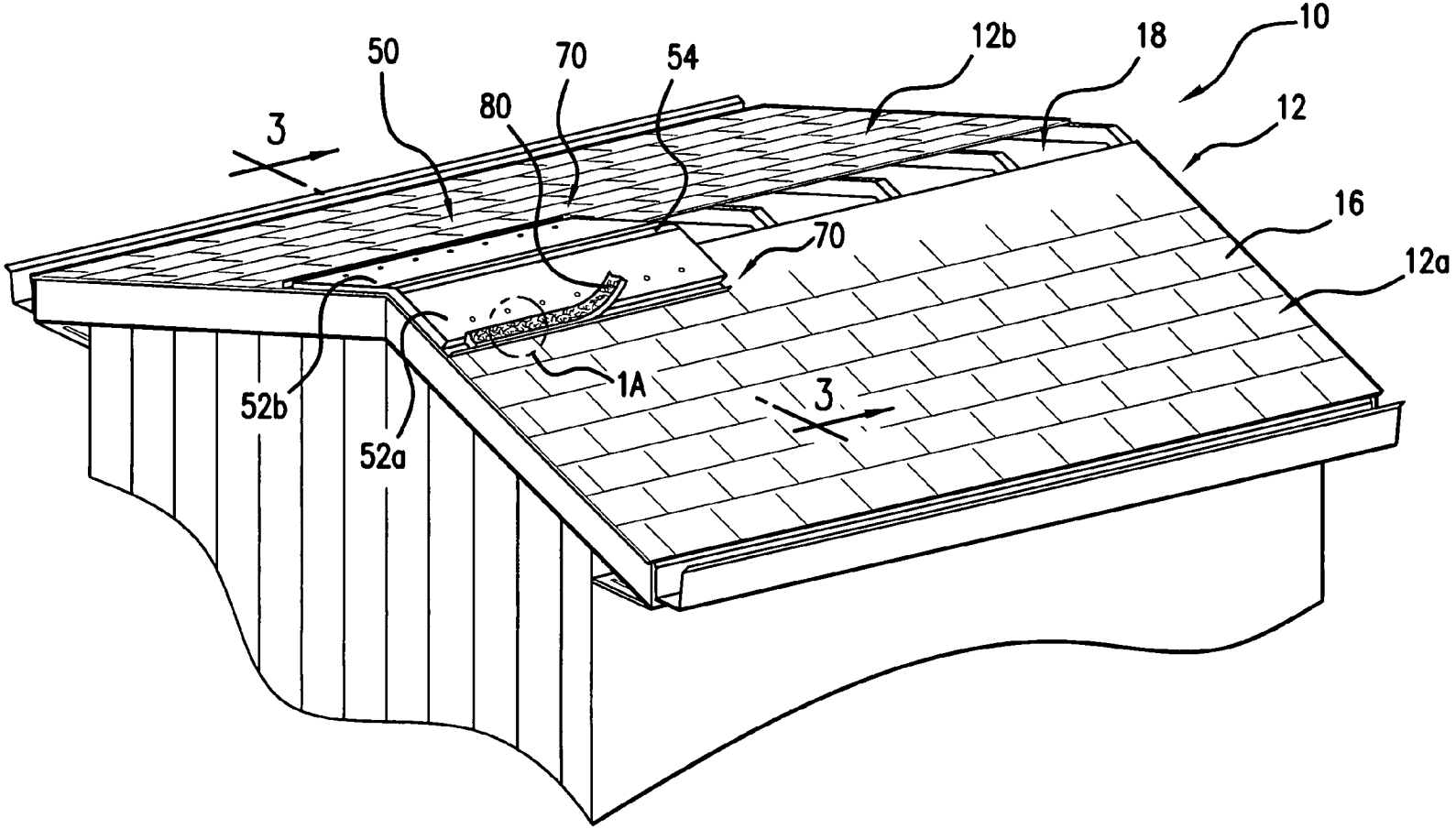
FIG. 1 depicts a perspective view of portions of a roof.

Certain terminology is used herein for convenience only and is not to be taken as a limitation on the present invention. Further, in the drawings, the same reference numerals are employed for designating the same elements.

FIG. 1 depicts an example of one or more roof vents being attached to a roof deck to form a roof incorporating aspects of the present invention. Roof vents described throughout this application may be used with a wide range of roof designs. For instance, roof vents may be used with various gabled or hipped roof designs. Roof vents can also be used with gambrel, saltbox, mansard, shed, flat or other roof designs. Roof vents can also be provided at or near the junction between a portion of the roof and an adjacent structure. For instance, roof vents can be provided at or near the junction between a portion of the roof and a vertical wall. FIG. 1 illustrates a roof vent 50 being attached to a gabled roof 10 with a roof deck 12 having two sloped roof deck portions 12*a*, 12*b*. If the roof is provided with sloped portions, the sloped roof deck portions can have a pitch with a wide range of slopes. For example, the roof deck portions can have a pitch that has a relatively low slope of less than about 30 degrees, a pitch with a relatively normal slope of about 30 degrees to about 45 degrees, or a pitch with a relatively steep slope of more than about 45 degrees. Still further, it is contemplated that the roof vent may be incorporated with other roof deck portions without a slope.

In the illustrated embodiment, the roof deck 12 can comprise a support structure 13 such as a layer of plywood or other structural layer of material. The support structure 13 can be attached to a roof rafter 14 or other framing arrangement and can comprise a single or multiple sheets of weather resistant material. For example, as shown in the figures, the roof deck 12 can include one or more layers of shingles 16 attached to an upper surface of the support structure 13. In further examples, the weather resistant material may comprise a water resistant sheet of material, a plurality of weather resistant material sheets, or other structures. Alternatively, or in addition, one or more weather resistant coatings may be employed. For example, the weather resistant material can comprise paint or other coating of weather resistant material or may include a weather resistant coating applied to one or more sheets of weather resistant material. In still further embodiments, the roof deck may comprise one or more single layers of material such as a plastic, metal, composite or other material that is weather resistant while also providing a sufficient support structure for the roof.

Figure 3:
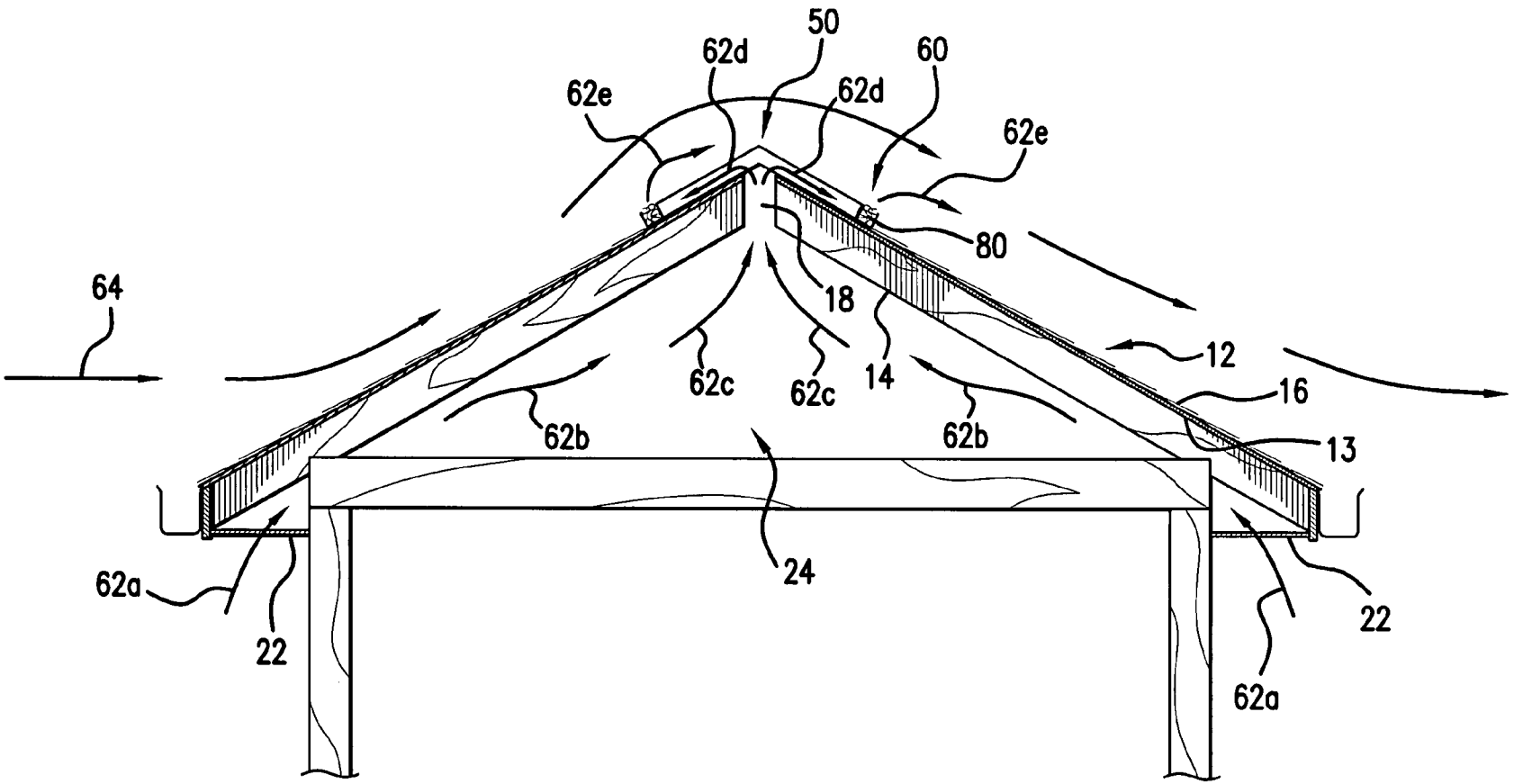
FIG. 3 is a sectional view of portions of a roof along line 3-3 of FIG. 1.

As shown in FIG. 1, the roof deck 12 may be provided with a ventilation opening 18 to facilitate venting of an area underlying the roof deck. For instance, as shown in FIG. 3, the ventilation opening 18 can facilitate venting of an attic area 24 underlying the roof deck 12. As shown, the ventilation opening 18 can be provided along substantially the entire ridge of the roof 10. In further examples, the ventilation opening may be provided over a portion of the ridge. Moreover, in a pyramidal hipped roof, the ventilation opening may be provided at the roof peak. Still further, the ventilation opening may be provided in a substantially planar surface. For instance, the ventilation opening may be provided at a central portion of one of the sloped surfaces away from the roof ridge or roof peak. In further examples, the ventilation opening may be provided along a portion of a substantially flat roof.

The roof vent 50 can be attached to the roof deck 12 and extend over the ventilation opening 18 to shield rain and debris from entering the attic area 24 by way of the ventilation opening 18. While a single roof vent 50 is illustrated in FIG. 1, a plurality of roof vents 50 may be provided to cover substantially the entire ventilation opening 18. Examples of a roof vent may include one or more walls. For instance, the roof vent may have a single wall or a pair of walls extending substantially along a single plane for use with roof decks having a ventilation opening with adjacent roof deck portions extending substantially along a single plane. For example, one or a plurality of walls of the roof vent may extend substantially along a single plane to cover ventilation openings provided away from a ridge or peak at a substantially planar area of the roof or to cover ventilation openings of a substantially flat roof. Roof vents may also include a plurality of walls adapted to extend along corresponding portions of a roof deck that are disposed at an angle relative to one another. For instance, a roof vent may include one wall configured to extend along the roof and another wall extending substantially vertically along a vertical wall of a building structure. In a further example, as shown, the roof vent can include a first wall 52*a* and a second wall 52*b* for extending along corresponding roof deck portions 12*a*, 12*b*. If provided with a plurality of walls, the walls may be joined at an angle with respect to one another to generally conform with the pitch of the roof. In one example, the first wall and the second wall may be attached at a fixed predetermined angular position to correspond with a roof having a specific pitch. In further examples, the first and second walls of the roof vent may have an adjustable connection to allow the first and second walls to pivot relative to one another. Providing an adjustable connection can allow the roof vent to conform to roofs having sloped roof deck portions with different pitches. In the illustrated embodiment, the first and second walls 52*a*, 52*b* are joined together with a hinge 54, such as a living hinge. The hinge 54 allows the first and second walls 52*a*, 52*b* to conform to the pitch of the roof 12 when installing the roof vent 50 to the roof 12.

Figure 1A:
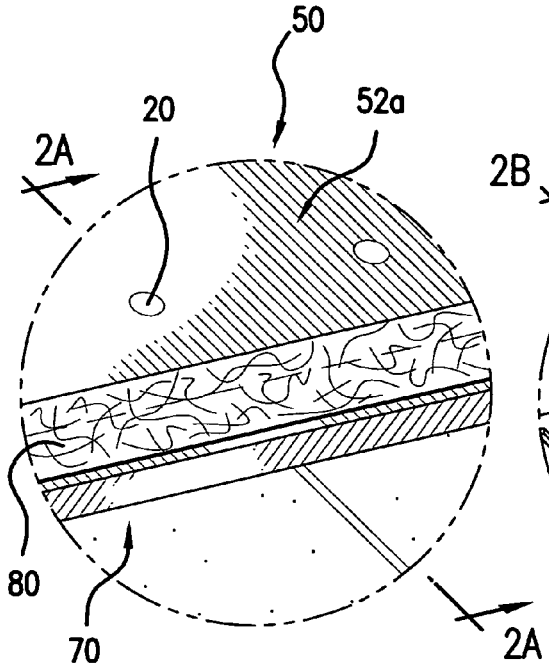
FIG. 1A is an enlarged view of a portion of the roof taken at view 1A of FIG. 1.
Figure 2A:
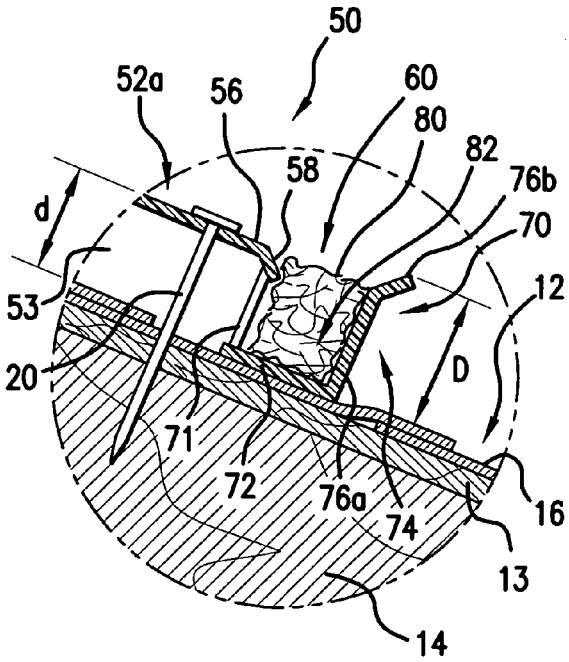
FIG. 2A is a sectional view of portions of a roof along line 2A-2A of FIG. 1A.

Although not required, roof vents in accordance with examples of the present invention can include one or more baffles. Moreover, if the roof vent includes a plurality of walls, one or more of the walls can include a corresponding baffle. In the illustrated embodiment, the first and second wall each include a corresponding baffle 70 that can be identical to one another. Aspects of an example baffle 70 are illustrated in FIGS. 1A and 2A and described with respect to the baffle attached to the first wall 52*a*. Such illustration and description can also equally apply to the baffle of the second wall 52*b* shown in FIG. 1. Baffles, if provided, can be beneficial to help control air flow about the roof vent. For example, the baffle 70 may cooperate with the first wall 52*a* to form a venturi opening 60. Wind passing over the venturi opening 60 can cause a low pressure zone to pull air out of a plenum area 53 defined between the roof deck 12 and the first wall 52*a* spaced from the roof deck 12.

As shown in FIG. 2A, the baffle 70 is shown spaced from the first wall 52*a* and attached to the first wall 52*a* by way of an attachment rib 71. The baffle 70 can include a base 72 and a flange 74 attached to the base. In order to enhance air flow through the plenum area 53, the upper surface of the first wall 52*a* can be spaced a first distance "d" from the roof deck 12 and the flange 74 can spaced from the wall 52*a* and extend from the roof deck 12 with a height "D" that is greater than or about equal to the first distance "d". The first wall 52*a* can also include a protrusion, such as a lip 58, extending downwardly from a substantially planar portion 56. Moreover, the flange 74 can include a first portion 76*a* and a second portion 76*b* extending outwardly at an angle from the first portion 76*a*. The outwardly extending second portion 76*b* and the lip 58 can also enhance air flow through the plenum area 53 and may also help interact with a guard as described more fully below.

Each roof vent in accordance with the present invention can include, or be provided with, a guard designed to allow passage of air while shielding areas of the roof vent from outside debris. Example of guards can comprise material and/or structure that has the capability of acting as a filter in addition to acting as a guard. Moreover, in accordance with aspects of the present invention, roof vents can be provided with removable guards that are configured to be selectively removed from the roof vent while the roof vent remains attached to the roof deck. In further examples, roof vents can include a guard that may be attached, such as non-removably attached, to one or more portions of the roof vent.

As shown in the example of FIGS. 1A and 2A, roof vent 50 can be provided with a removable guard 80 that may be configured to be selectively removed from the roof vent 50 while the roof vent 50 remains attached to the roof deck 12. Providing a removable guard can provide a wide range of benefits. For instance, a removable guard can permit retrofitting of an existing roof vent to help shield areas of the roof vent from debris. In further examples, a removable guard can allow easy replacement and/or cleaning of previously-installed guards that might become soiled after a period of time. As shown in the illustrated example, a portion of the removable guard (e.g., a top portion) may substantially extend in a direction from the first wall 52*a* towards the first baffle 70 to allow debris to be blown from the roof vent. Removable guards can be formed with a wide range of structures and from a wide range of materials. For instance, the removable guard can comprise a guard wall with a plurality of vent openings removably attached relative to a portion of the roof vent. In the illustrated example, the removable guard 80 can comprise a natural and/or synthetic fibrous material and/or recycled post-industrial fiber material. For instance natural materials may comprise one or more of coconut husk and/or hog hair that may be covered with a ultraviolet resistant latex. In one example, the guard can include fibrous material available from Blocksom & Company of Michigan City, Ind. In a further example, the guard can include fibrous material available from Colbond Inc. of Enka, N.C. Although other materials may be used, one or more examples of materials for a guard can comprise open and/or closed cell foam, multi-dimensional matrix and nonwoven products, and/or fabrics or the like.

If the roof vent includes a baffle, the removable guard may be designed to cooperate with one or more aspects of the baffle. For example, as shown in FIG. 2A, the baffle 70 can at least partially define a guard containment area 82 wherein the removable guard 80 may be selectively placed within the guard containment area 82. Once placed within the guard containment area 82 the removable guard 80 is positioned between a portion of the baffle 70 and a portion of the first wall 52*a* such that the venturi opening 60 and the removable guard 80 are both positioned along an air flow path.

The roof vent and removable guard can also be configured for removable attachment of the removable guard to the roof vent. For instance, the removably guard can be hooked, snapped, clipped or otherwise removably attached to the roof vent. In addition, or alternatively, the removable guard can be frictionally attached to the roof vent. In the illustrated embodiment, the removable guard 80 is slightly oversized to enhance frictional engagement between the removable guard 80 and portions of the roof vent 50.

Features of the baffle, a peripheral edge of the first wall, and/or other portions of the roof vent can optionally be configured to facilitate insertion of the removable guard into the guard containment area and/or inhibit removal of the removable guard from the guard containment area. For example, as set forth above, the removable guard can be hooked, snapped, clipped, frictionally attached, or otherwise removably attached with respect to the roof vent. In the illustrated example, a peripheral edge of the first wall 52*a* can comprise a protrusion, such as a lip 58, extending downwardly from the substantially planar portion 56 in a direction towards the guard containment area 82. The ramped surface of the lip 58 can facilitate insertion of the removable guard 80 into the guard containment area 82. Moreover, once inserted, the lip 58 can dig into the removable guard 80 to inhibit removal of the removable guard 80 from the guard containment area 82. As shown, the second portion 76*b* of the flange 74 can also include a ramped surface to facilitate insertion of the removable guard 80 into the guard containment area 82. While the optional protrusion is illustrated as a lip 58, it is contemplated that the protrusion may comprise other structures. For example, the protrusion can comprise one or more fingers, tabs, teeth or other structures that can interact with the removable guard to inhibit removal of the removable guard from the guard containment area.

Figure 1B:
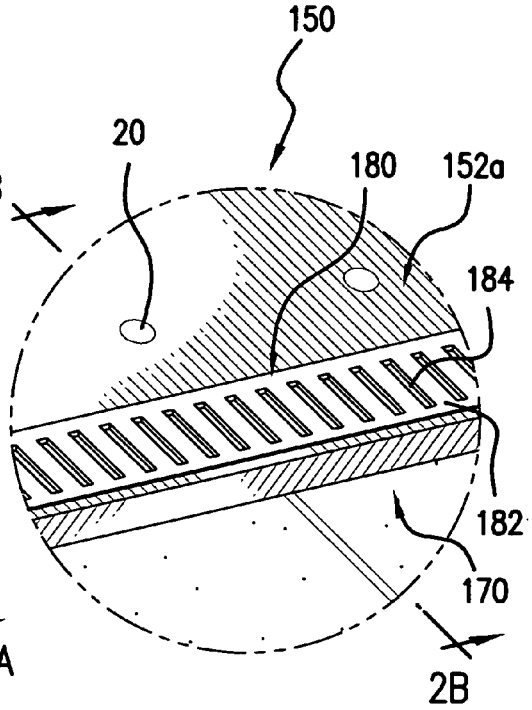
FIG. 1B is an enlarged view of a portion of a roof similar to FIG. 1A but depicting portions of an alternative roof vent.
Figure 2B:
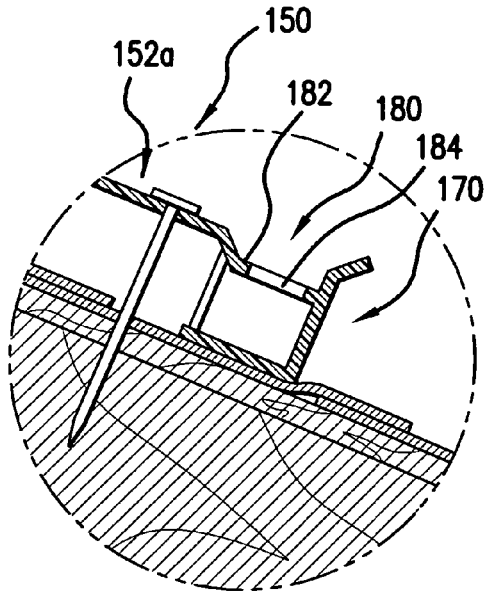
FIG. 2B is a sectional view of portions of a roof along line 2B-2B of FIG. 1B.

As mentioned previously, roof vents can include a guard that may be non-removably attached to a portion of the roof vent. FIGS. 1B and 2B depict aspects of one alternative roof vent including a guard that is non-removably attached to a portion of the roof vent. As shown, the example of the alternative roof vent 150 can include a guard 180 comprising a guard wall 182 extending in a direction from a first wall 152*a* towards a first baffle 170. The guard wall 182 includes a plurality of vent openings 184 configured to permit passage of air while acting as a shield against debris. The vent openings may comprise circular or elongated apertures or other openings and can be arranged in a wide variety of patterns. In the illustrated embodiment, the vent openings 184 comprise a plurality of slots extending in the direction from the first wall 52*a* to a portion of the baffle 170. In further examples, the slots may be disposed at an angle, such as 90 degrees with respect to the depicted orientation.

The guard 180 may be attached to one or more portions of the roof vent in a wide variety of ways. For example, the guard may be integrally or nonintegrally attached to the first wall and/or the baffle. In the illustrated example, the guard 180 is integral with the first wall 152*a* and the baffle 170. In further examples, the guard may be integral with only one of the first wall 152*a* or the baffle 170. The guard may be attached to the one or more portions of the roof vent in a wide variety of ways. For example, the guard may be glued or sonic welded to one or more portions of the roof vent. In further examples, the guard may be formed together with the remaining portions of the roof vent. For example, the guard may be injection molded with one or more portions of the roof vent.

Installation of the roof vent will be described with respect to the roof 12 illustrated in FIG. 1. First, the vent opening 18 can be formed in the ridge of the roof 12. Next, a plurality of roof vents 50 can be aligned with respect to one another to cover substantially the entire vent opening 18. Next, nails 20 or other fasteners are used to attach the first and second walls 52*a*, 52*b* to the respective first and second roof deck portions 12*a*, 12*b*. Although not shown, an optional layer material, such as shingles, may be provided over the top surface of the first and second walls 52*a*, 52*b*. At any time during formation of the roof 10, the removable guards 80 may be inserted in the guard containment areas 82 of the roof vents 50. For example, the guards 80 may be factory-installed such that the roof vents 50 are provided with the guards 80 already appropriately placed in the guard containment areas 82. In a further example, the guards 80 may be installed at a later time. For instance, the guards 80 may be installed on-site prior to, or after, attaching the roof vent to the roof deck. Furthermore, in accordance with further aspects of the invention, the guards 80 may be installed on an existing roof vent already attached to the roof deck.

FIG. 3 illustrates portions of the roof of FIG. 1 wherein features of the roof are shown in schematic form. In operation, wind 64 passes over the roof deck portions and over the roof vent 50. The wind passes over the venturi openings 60 to create a low pressure zone that draws air from the attic 24 underlying the roof deck 12. As shown, air is drawn from outside the attic 24 along paths 62*a* and through vented soffit panels 22. Next, air streams 62*b* move in a direction from the vented soffit panels 22 toward the ventilation opening 18. Next, air streams 62*c* pass through the ventilation opening 18. Air streams 62*d* then travel within the plenum space 53 between the first and second walls 52*a*, 52*b* and the roof deck portions 12*a*, 12*b*. The air stream paths 62*e* then pass through the removable guard 80 and the venturi opening 60. The removable guard 80 therefore permits passage of the air stream while also shielding areas of the roof vent from unwanted debris. Moreover, removable and/or non-removable guards can allow the wind 64 to blow debris over the guard of the roof vent for hands-free cleaning of the guard. For example, as the guards can substantially fill or cover an area of the corresponding baffle and extend in a direction from the corresponding wall and corresponding portion of the baffle, leaves and other debris may be simply blown off the roof vent rather than becoming trapped within areas of the roof vent.

From the above description of the invention, those skilled in the art will perceive improvements, changes and modifications. Such improvements, changes and modifications within the skill of the art are intended to be covered by the appended claims.

What is claimed:

1. A roof comprising:

a roof deck including a ventilation opening and a weather resistant material;

a roof vent attached to the roof deck and extending over the ventilation opening wherein the roof vent includes, along an outer edge of the roof vent, a wall spaced from the roof deck and a baffle spaced from the wall, wherein the baffle includes a flange spaced from the wall to at least partially define a containment area, and a space between the flange and the wall defines an upper opening into the containment area; and a removable external filter substantially filling the containment area and extending across the upper opening, wherein the removable external filter is configured to be selectively removed from the roof vent while the roof vent remains attached to the roof deck.

2. The roof of claim 1, wherein the upper opening comprises a venturi opening, wherein the venturi opening and the removable external filter are positioned along an air flow path.

3. The roof of claim 1, wherein an upper surface of the wall is spaced a first distance from the roof deck, and the flange extends from the roof deck with a height that is greater than the first distance.

4. The roof of claim 1, wherein the wall includes a substantially planar portion and a protrusion extending downwardly from the substantially planar portion in a direction towards the external filter containment area to facilitate insertion of the removable external filter into the containment area and inhibit removal of the removable external filter from the containment area.

5. The roof of claim 1, wherein the removable external filter is frictionally attached within the containment area of the baffle.

6. A roof vent comprising:

a body including a first wall and a second wall attached to the first wall;

a first baffle spaced outwardly and away from the first wall along an outer edge of the roof vent, wherein the first baffle includes a first flange spaced from the first wall to at least partially define a first containment area, and a space between the first flange and the first wall defines an upper opening into the first containment area; and a first removable external filter substantially filling the first containment area and extending across the upper opening.

7. The roof vent of claim 6, further comprising a second baffle spaced outwardly and away from the second wall, wherein the second baffle includes a second flange spaced from the second wall to at least partially define a second containment area, and a space between the second flange and the second wall defines an upper opening into the second containment area; and a second removable external filter substantially filling the second containment area and extending across the upper opening of the second containment area.

8. The roof vent of claim 6, wherein the first removable external filter is frictionally attached within the first containment area of the first baffle.

9. The roof vent of claim 6, wherein a peripheral edge of the first wall is configured to facilitate insertion of the first removable external filter into the first containment area and inhibit removal of the first removable external filter from the first containment area.

10. The roof vent of claim 6, wherein the first wall includes a substantially planar portion and a lip extending downwardly from the substantially planar portion in a direction towards the first containment area to facilitate insertion of the first removable external filter into the first containment area and inhibit removal of the first removable external filter from the first containment area.

* * * * *